US006540870B1

(12) United States Patent
Laurila-Lumme et al.

(10) Patent No.: US 6,540,870 B1
(45) Date of Patent: Apr. 1, 2003

(54) PROCESS FOR SUBSTANTIALLY RETARDING DISSOLUTION OF CALCIUM CARBONATE IN A PAPERMAKING SYSTEM

(75) Inventors: Auli Laurila-Lumme, Kaipola (FI); Heikki Pakarinen, Valkeakoski (FI); Hannu Juhani Leino, Espoo (FI)

(73) Assignees: AGA Aktiebolag, Lidingo (SE); UPM-Kymmene Corp., Helsinki (FI)

( * ) Notice: Subject to any disclaimer, the term of this patent is extended or adjusted under 35 U.S.C. 154(b) by 0 days.

(21) Appl. No.: 09/462,170

(22) PCT Filed: Jun. 25, 1998

(86) PCT No.: PCT/FI98/00558

§ 371 (c)(1),
(2), (4) Date: Jan. 3, 2000

(87) PCT Pub. No.: WO99/35333

PCT Pub. Date: Jul. 15, 1999

(30) Foreign Application Priority Data

Mar. 3, 1998 (FI) ..... 980478

(51) Int. Cl.[7] ..... D21H 17/64; D21H 17/69

(52) U.S. Cl. ..... 162/8; 162/9; 162/158; 162/181.2; 162/181.4; 162/183

(58) Field of Search ..... 162/63, 181.4, 162/183, 158, 181.1, 4, 8, 90, 181.2

(56) References Cited

U.S. PATENT DOCUMENTS

| | | | | |
|---|---|---|---|---|
| 1,993,265 A | | 3/1935 | Dyer | |
| 2,114,809 A | | 4/1938 | Rawling | |
| 5,043,017 A | | 8/1991 | Passaretti | |
| 5,156,719 A | | 10/1992 | Passaretti | |
| 5,223,090 A | * | 6/1993 | Klungness et al. | 162/9 |
| 5,262,006 A | | 11/1993 | Andersson et al. | |
| 5,378,322 A | | 1/1995 | Hornsey | |
| 5,505,819 A | | 4/1996 | Dewitt et al. | |
| 5,643,415 A | * | 7/1997 | Wise | 162/181.2 |
| 5,679,220 A | | 10/1997 | Mattthew et al. | |
| 6,200,416 B1 | * | 3/2001 | Brotto et al. | 162/4 |
| 6,228,161 B1 | * | 5/2001 | Drummond | 162/181.2 |

FOREIGN PATENT DOCUMENTS

| | | |
|---|---|---|
| EP | 0 281 273 | 9/1988 |
| EP | 0 296 198 | 12/1988 |
| EP | 0 445 952 | 9/1991 |
| EP | 0 791 685 | 8/1997 |
| GB | 2 008 562 | 6/1979 |
| WO | 96 26901 | 9/1996 |
| WO | 96 28517 | 9/1996 |
| WO | 97 14651 | 4/1997 |
| WO | 98 29601 | 7/1998 |
| WO | 98 56988 | 12/1998 |

OTHER PUBLICATIONS

Östberg Gunilla, et al, "Use of Carbon Dioxide in the Production of Sulphate Pulp", 5$^{th}$ International Conference on New Available Techniques, Stockholm, Jun. 4–7, 1996.
"Deinking pH control: putting $CO_2$ to work" TAPPI Journal, Jul. 1992, pp. 247–248.

(List continued on next page.)

*Primary Examiner*—Steve Alvo
(74) *Attorney, Agent, or Firm*—Browdy and Neimark, P.L.L.C.

(57) ABSTRACT

The invention relates to papermaking processes wherein calcium carbonate is included in a pulp suspension. The dissolution of the calcium carbonate in the papermaking system is prevented or substantially retarded by the introduction of carbon dioxide to said pulp suspension in connection with subjecting said calcium carbonate in said papermaking system to pH conditions of about 8 or lower. The invention also provides processes for the production of paper or board in papermaking systems wherein solid calcium carbonate is present as a filler and/or pigment.

32 Claims, 3 Drawing Sheets

OTHER PUBLICATIONS

Denilson Nunes dos Santos, et al, "The Use of $CO_2$ in the Manufacture of Paper with TMP at Melhoramentos" O PAPEL, Apr. 1995, pp. 51–54, Transl.

Werner Stumm and James J. Morgan, "Aquatic Chemistry, Chemical Equilibria and Rates in natural Wtaers" Environment Science and Technology, John Wiley and Sons. 3$^{rd}$ Ed. 1996,ISBN 0–471–51184–6, pp. 148–190 and pp. 373–386.

Eklund et al., "Paper Chemistry", *DT Parer Science Publications*, pp. 250, (1991).

* cited by examiner

PROCESS FOR SUBSTANTIALLY RETARDING DISSOLUTION OF CALCIUM CARBONATE IN A PAPERMAKING SYSTEM

CROSS REFERENCE TO RELATED APPLICATION

The present application is the national stage under 35 U.S.C. 371 of PCT/FI98/00558, filed Jun. 25, 1998.

The present invention relates to the art of papermaking. In particular the invention relates to papermaking processes wherein calcium carbonate is included in a pulp suspension, Specifically, the present invention provides a process for preventing or substantially retarding the dissolution of calcium carbonate in the papermaking system. The invention also provides processes for the production of paper or board in papermaking systems wherein solid calcium carbonate is present as a filler and/or pigment.

The pulp suspension used according to the present invention may comprise recycled pulps or virgin mechanical or chemical pulps, or mixtures thereof. Special benefits of the present invention are obtained when calcium carbonate containing recycled fibers are processed into paper in accordance with the invention.

Calcium carbonate $CaCO_3$ is commonly used in paper making as a filler or pigment because it has a high brightness and it is the whitest filler in the price range in question. The calcium carbonate may be naturally occurring chalk or calcite or it may be synthetically produced precipitated calcium carbonate (PCC). Calcium carbonate is sparingly soluble in alkaline conditions above a pH of about 8, but it is attacked by acids such as sulfuric acid and alum, as a result of which it is solubilized. Consequently, normal calcium carbonate is no t a suitable filler for paper making at an acidic pH.

In an attempt to solve the problem with solubilization of calcium carbonate at acidic pH an acid resistant precipitated calcium carbonate has been provided. However, production of this calcium carbonate is technically complicated making the use thereof expensive and even so this product is not either totally acid resistant.

Some papermakers have converted their processes from acidic to neutral pH, partly in order to be able to use calcium carbonate as a filler and/or pigment. The expression "neutral pH" corresponds in these processes to a pH in the short circulation of approximately 7–8.5, most preferably 7–8. This applies especially to paper produced from bleached chemical and mechanical pulps. The expression "pseudo-neutral pH" refers to a pH below that at which calcium carbonate dissolves and it generally refers to a pH of 7 or lower.

In the papermaking processes calcium carbonate is added as a filler to the stock prior to paper formation and consequently a part of the filler particles will enter the process waters circulating in the papermaking system. When calcium carbonate is used as a pigment in coated papers, a part of the calcium carbonate will be recirculated to the process with the broke.

Recycled waste paper as well as broke (herein generally referred to as recycled fibers) may contain calcium carbonate as filler and/or pigment. The repulping of recycled fibers is generally performed at an alkaline pH wherein the calcium carbonate remains essentially in solid form. However, if the paper machine is run at an acidic, neutral or pseudo-neutral pH range, the calcium carbonate deriving from the recycled fibers will start to dissolve.

Also under alkaline conditions the stock preparation and the short circulation includes addition of a number of paper chemicals and dilution waters, some of which are acidic and therefore decrease the pH of the pulp. At each acidic addition calcium carbonate may be lost and there may be foaming problems due to a decomposition of dissolved calcium carbonate.

Solubilized calcium carbonate dissociates in water according to the following equations $$CaCO_3 \leftrightarrows Ca^{2+} + CO_3^{2-}$$

$$CO_3^{2-} + H_2O \leftrightarrows HCO_3^- + OH^-$$

$$HCO_3^- + H_2O \leftrightarrows H_2CO_3 + OH^-$$

$$H_2CO_3 \leftrightarrows CO_2 + H_2O$$

At a pH below about 8 the dissolution of calcium carbonate and consequently the concentration of free calcium ions increases and foaming is observed as carbon dioxide gas is released. With use of closed circulating waters in the papermaking system, the solubilization of calcium carbonate accumulates high concentrations of calcium ions which cause complex problems in the papermaking. Among these problems there may be mentioned coagulation of sticky particles, soap and ink particles; precipitation of inorganic calcium salts as a scaling; precipitation of calcium oxalate and reprecipitation of calcium carbonate; a decrease in the swelling ability of the fibers; interference with retention aids, dispersants and other charged paper additives; etc.

Consequently, there exists a need to improve the use of calcium carbonate in paper making processes.

Carbon dioxide is a gas, which dissolves in water or a pulp suspension forming carbonic acid and/or bicarbonate ions according to the reaction:

$$CO_2 + H_2O \leftrightarrows H_2CO_3 \leftrightarrows H^+ + HCO_3^-$$

Use of carbon dioxide in paper making has been suggested in the prior art for various reasons. According to U.S. Pat. No. 1,993,265 carbon dioxide is used for inhibiting the destructive action of calcium carbonate on a rosin size precipitated with alum.

According to U.S. Pat. No. 2,114,809 a calcium carbonate containing stock is sized using alum, whereby carbon dioxide is created in the reaction between alum and carbonate filler.

According to U.S. Pat. No. 5,378,322 bicarbonate ions required for catalyzing non-acidic sizing with alkylketene dimers may be generated by dissociation of carbon dioxide in the aqueous pulp. If calcium carbonate is added as a filler, the catalytic bicarbonate ions may be produced by a reaction between dissolved carbon dioxide and calcium carbonate. However, this combination of carbon dioxide and calcium carbonate is proposed only for a pH down to 8.6.

According to U.S. Pat. No. 5,262,006 precipitation of gypsum in an alkaline recycle or broke derived pulp may be prevented by adding carbon dioxide to form bicarbonate ions in the alkaline pulp and to precipitate the calcium as calcium carbonate providing PCC in the processing system.

According to EP Patent 0 296 198 the washing of alkaline pulps may be improved by adding carbon dioxide to the washing water.

According to EP Patent 0 281 273 carbon dioxide may be used for adjusting the pH of alkaline pulps upstream of the fibrilation step.

According to GB Patent Application 2 008 562 carbon dioxide may be used for increasing the solubility of calcium carbonate and for the hardening of recycled waters used in the treatment of pulp from waste paper.

It is well known in the art that the solubility of calcium carbonate increases with decreasing pH. According to literature (D. Eklund, T. Lindström, Paper Chemistry—an introduction, DT Paper Science Publications, Grankulla, Finland 1991, p. 253) an increase in the carbon dioxide partial pressure increases the solubility of calcium carbonate. Consequently, the prior art papermaking processes have recommended the use of calcium carbonate as a filler for alkaline but not for acidic or neutral papermaking.

It has now surprisingly been found that carbon dioxide may be used to improve the function of calcium carbonate in paper making processes operating at pH levels below those at which calcium carbonate traditionally has been used.

Consequently, the present invention relates to a process for reducing or substantially retarding the dissolution and/or dissociation of calcium carbonate in a papermaking system. The process comprises the steps of providing an aqueous pulp suspension in said papermaking system; causing solid calcium carbonate to be present in said pulp suspension; and introducing carbon dioxide to said pulp suspension in connection with subjecting said calcium carbonate in said papermaking system to pH conditions of about 8 or lower.

The carbon dioxide is introduced in an amount sufficient to significantly retard dissolution of said calcium carbonate in said pulp suspension and reduce the amount of free calcium ions in said papermaking system compared to a similar system operating without carbon dioxide.

The fact that carbon dioxide does retard the dissolution of calcium carbonate is in itself surprising and contrary to the beliefs of the prior art. Without wishing to be bound by any theory, the inventors believe that the effect of the carbon dioxide is due to the increased amount of carbonate ions which result from the dissolution of carbon dioxide in the aqueous medium. These carbonate ions affect the balance of the dissociation equation of calcium carbonate in such a way that calcium carbonate has a lower tendency for dissolving and dissociating. Thus, a large part of the calcium carbonate is maintained in solid form and is removed with the paper web. The amount of free calcium ions in the pulp suspension and in the circulating process waters is significantly reduced and there is no accumulation of calcium ions.

The required amount of added carbon dioxide depends on the pH, on the other process conditions as well as on the amount of calcium carbonate present in the pulp suspension. The amount of carbon dioxide added to the pulp suspension may be significant, up to about 5 to 7 kg/ton or even more. Trials have been made with values between 2 and 15 kg/ton with good results. A high amount of carbon dioxide has a clear pH lowering effect on the pulp suspension and a lower pH is known to increase the solubilization of calcium carbonate. However, in the working of the present invention it was surprisingly found that the carbon dioxide retarded the dissolution of calcium carbonate even though the pH was decreased. Thus, decreasing the pH with carbon dioxide does not have the same negative effects on calcium carbonate as decreasing the pH with other acids.

The calcium carbonate in the pulp suspension may derive from calcium carbonate added to the pulp suspension as a filler or it may be provided by calcium carbonate included as a coating pigment in recirculated broke. Alternatively, the calcium carbonate in the pulp suspension may derive from recycled fibers containing significant amounts of calcium carbonate as filler and/or pigment.

The present invention also provides a process for producing paper or board in a papermaking system wherein solid calcium carbonate is present. The process comprises the steps of providing an aqueous pulp suspension in said papermaking system; causing solid calcium carbonate to be present in said pulp suspension; introducing carbon dioxide to said pulp suspension in connection with subjecting said calcium carbonate in said system to pH conditions of about 8 or lower, said carbon dioxide being added into said pulp suspension in an amount which substantially retains said solid calcium carbonate in an undissolved state for a time sufficient for said stock to be processed into a web; feeding said calcium carbonate containing pulp suspension via stock preparation steps to a web forming device; and processing said web into paper having calcium carbonate filler.

The present invention further provides a process for producing paper or board from recycled fibers, which process includes the steps of processing recycled fibers including calcium carbonate at an alkaline pH to provide a calcium carbonate containing alkaline recycled pulp suspension; introducing carbon dioxide to said calcium carbonate containing pulp suspension prior to and/or in connection with said calcium carbonate containing pulp suspension being subjected to pH conditions of about 8 or lower; feeding said pulp suspension to stock preparation in a paper making machine; and producing paper including calcium carbonate filler from said stock.

If the pH in a calcium carbonate containing suspension is lowered with a strong acid such as sulfuric acid to the critical level of pH about 8, the calcium carbonate will start to dissolve. The dissolving is generally the quicker the lower the pH is. In some cases it may be acceptable to lower the pH of the pulp suspension to as low as 7.5 or even 7 with other acids, provided that carbon dioxide is introduced into the suspension fairly quickly after the pH decrease below about 8. It is preferable, however, to provide any pH decrease below about pH 8 with the carbon dioxide itself, in which case the solubilization of calcium carbonate will be retarded according to the invention.

Figure 1:
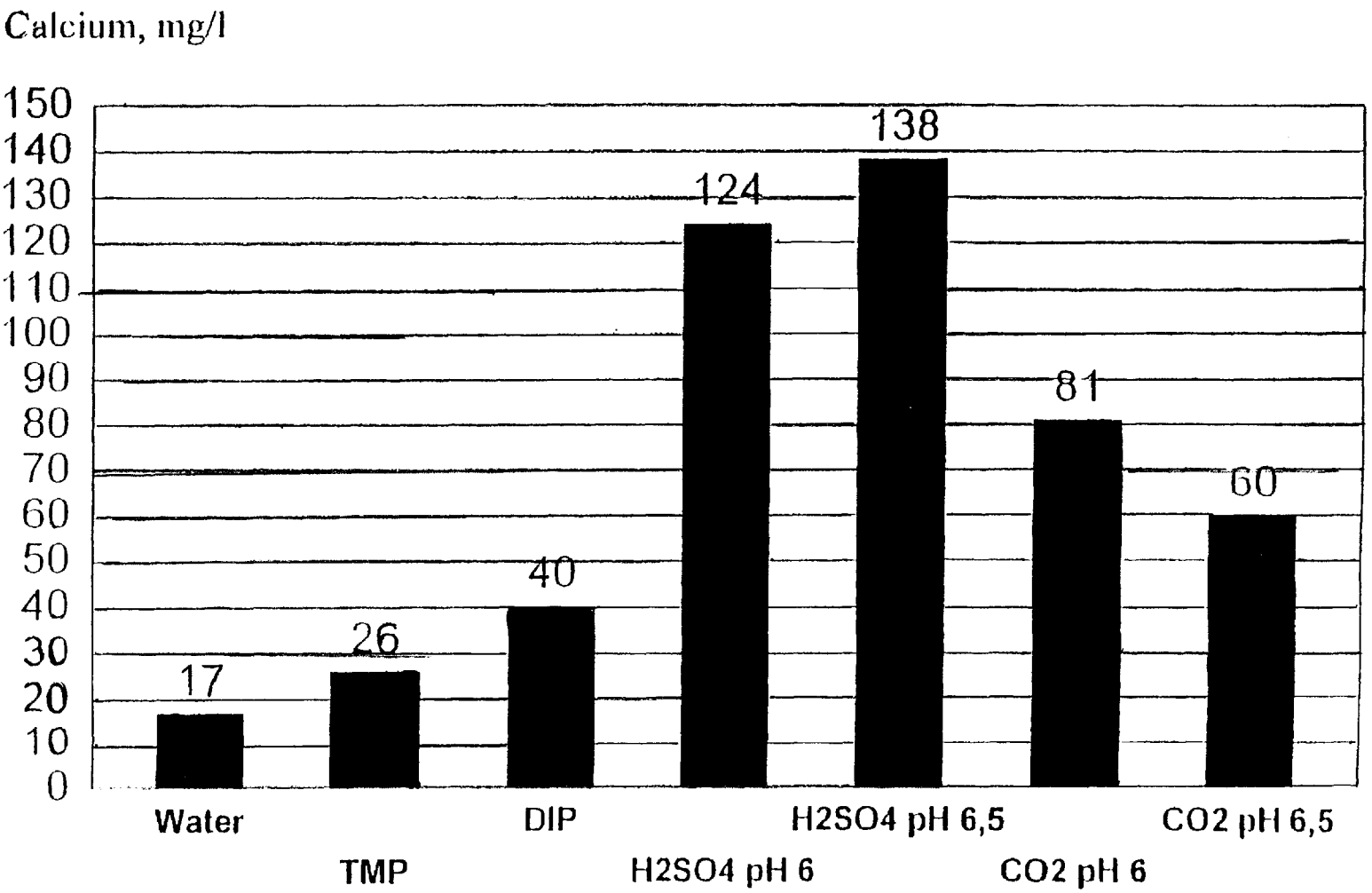
FIGS. 1–3 show the results of Example 1, Test Runs 1 to 3 respectively.

In the operation of the present invention the carbon dioxide should be introduced into the pulp suspension in connection with subjecting the calcium carbonate to pH conditions below the critical level where it would otherwise dissolve. The term "in connection with" as used in this context in the present specification and claims is intended to mean that the carbon dioxide is introduced at a point prior to, simultaneously with or slightly after the point wherein calcium carbonate being subjected to said pH conditions. Preferably, the carbon dioxide introduction is performed in close connection with the operation providing the said pH conditions. When the carbon dioxide is introduced at an earlier stage, care should be taken that the carbon dioxide does not evaporate or that its effect is not consumed before contacting said calcium carbonate. If carbon dioxide is introduced at a later stage, care should be taken to ensure that the time during which the calcium carbonate is subjected to said pH conditions without carbon dioxide is short so as to minimize the dissolving effect.

In cases where calcium carbonate is added into the pulp suspension, e.g. in the form of a slurry the carbon dioxide is preferably introduced at a location physically close to the point of addition of calcium carbonate, especially if said addition is performed at pH conditions of 8 or lower. When the carbon dioxide is introduced prior to the addition of calcium carbonate, the number of unit operations between the introduction of carbon dioxide and adding of calcium carbonate should be minimized and the carbon dioxide should preferably be introduced in one of the preceding unit operations in order to ascertain that the carbon dioxide is actively present to counter the solubilization of calcium carbonate.

The carbon dioxide may be introduced into a stream of pulp suspension or it may be introduced into a stream of water, such as into a recirculating process water, which is then added to said pulp suspension.

Additional carbon dioxide may preferably be introduced into said calcium carbonate containing pulp suspension in connection with additions of acidic process chemicals to said pulp suspension.

As mentioned above, carbon dioxide has an inherent capacity of decreasing the pH and this capacity may be utilized in the present invention in order to provide a desired decrease in the pH of a pulp suspension. Thus, carbon dioxide may be introduced in an amount sufficient for lowering the pH of said pulp suspension down to the critical level of pH 8 or below, or, when another acid has been used for decreasing the pH to about 8, carbon dioxide may preferably be used to decrease the pH further, e.g. to a pH level of about 7.6 or lower. The pH of the pulp suspension may, for instance, be adjusted with carbon dioxide to a pH of 5.5 to 7.6, preferably 6.5 to 7.5.

The recycled waste material supplied to a paper mill generally goes through the steps of slushing or repulping, cleaning, deinking and possibly bleaching before it is fed into the paper making process to provide stock for the paper making.

The carbon dioxide may be introduced into a pulp composed of recycled fibers which are processed at an alkaline pH in a deinking plant or in a slusher. Such processing of recycled fibers generally involves dilutions with recirculating waters and it may include one or more adjustments of the pH of the suspension. The carbon dioxide should preferably be introduced prior to and/or in connection with the step in which the calcium carbonate containing pulp suspension being diluted with water having a pH of 8 or lower.

Recycled fibers and/or mechanical fibers are often bleached with bleaching agents such as dithionite which cause a reduction in the pH due to side reactions in the bleaching or by-products of the bleaching agent. The properties of the stock itself also affects the amount of pH reduction which may occur. To counter the pH reducing effect, carbon dioxide should preferably be introduced prior to the dithionite bleaching of a calcium carbonate containing pulp suspension in order to minimize the acceleration of dissolution of calcium carbonate which may otherwise take place.

When a calcium carbonate containing recycled pulp having an alkaline pH enters a paper making process operating at a neutral or acidic pH, carbon dioxide is preferably introduced into the pulp just before the contact between liquids at different pH levels takes place. A suitable position for carbon dioxide introduction is in connection with pumping a calcium carbonate containing recycled pulp to a storage tank of a paper machine.

Aqueous pulp suspensions deriving from chemical or mechanical pulps are basically devoid of calcium carbonate. In such cases calcium carbonate may comprise a solid filler which is added into said pulp suspension in a papermaking process. The calcium carbonate is preferably added in a stock preparation step such as prior to and/or in a stock preparation tank.

The calcium carbonate which first enters the pulp suspension may also comprise calcium carbonate contained in process waters recirculated from said papermaking process. In such a case it may be preferable to introduce the carbon dioxide into the process water just before it enters the pulp suspension. Additional carbon dioxide may then be introduced into the stock at a subsequent process step prior to web forming.

In the operation of the process according to the present invention carbon dioxide should be introduced into the pulp suspension in an amount sufficient to significantly increase the amount of undissolved calcium carbonate in the stock entering the web forming device of the papermaking machine compared to a corresponding stock which has not been treated with carbon dioxide.

The present invention improves the use of calcium carbonate containing pulps in paper production at a substantially neutral or even acidic pH.

Various situations wherein the problems of solubilization and dissociation of calcium carbonate are encountered in papermaking are described below with the aid of some examples. Said examples are only illustrative of the invention and should in no case be taken as limiting the scope of the invention.

EXAMPLE 1

Laboratory Tests Showing the Effect of Carbon Dioxide on the Dissolution of Calcium Carbonate A pulp comprising de-inked pulp (DIP) and/or thermomechanical pulp (TMP) at a consistency of 3 to 4% and at a temperature of 50° C. were mixed with carbon dioxide in a covered laboratory mixer. A calcium carbonate slurry was added to the pulp after the addition of carbon dioxide. The mixing time was 2 hours. Thereafter the pulp was filtered using a Blue band filter pad (Slicer & Scholl 589/3) and the amount of calcium present in the filtrate was measured using an Atom Absorption Spectrometer (AAS).

In test No. 1, the pH of a pulp blend of DIP and TMP was lowered to 6.5 and 6.0, respectively, using a) $H_2SO_4$ and b) $CO_2$. The results are indicated in FIG. 1 (Content of dissolved calcium in TMP—DIP blends).

Figure 2:
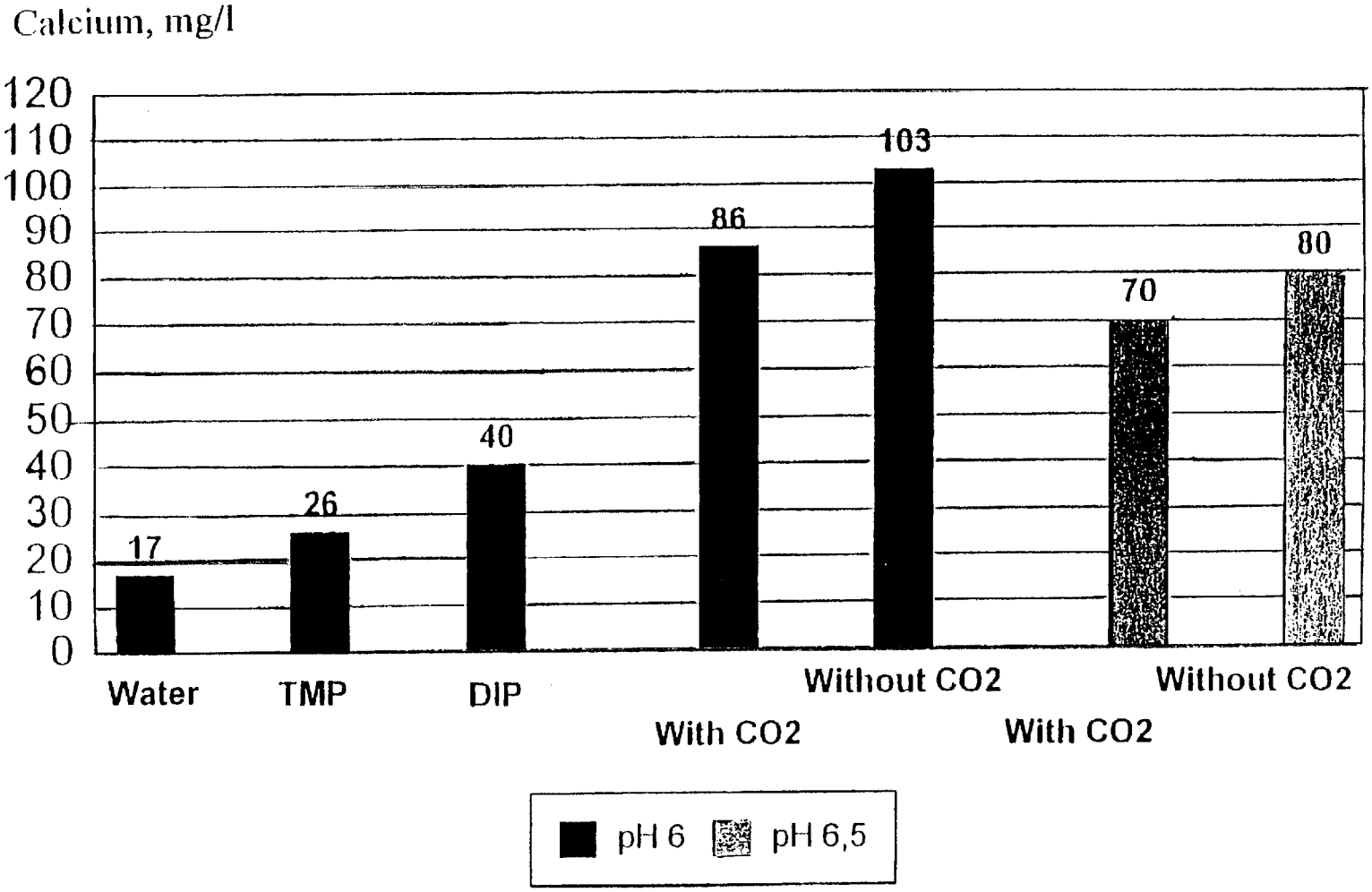

In test No. 2, the pH of a pulp blend of DIP and TMP was adjusted to 6.5 and 6.0, respectively, as in the first test. An addition of acetic acid corresponding to an addition of 5 kg acetic acid per ton was made to the respective pulp suspensions. The results are indicated in FIG. 2 (Content of calcium after acetic acid 5 kg/t addition).

Figure 3:
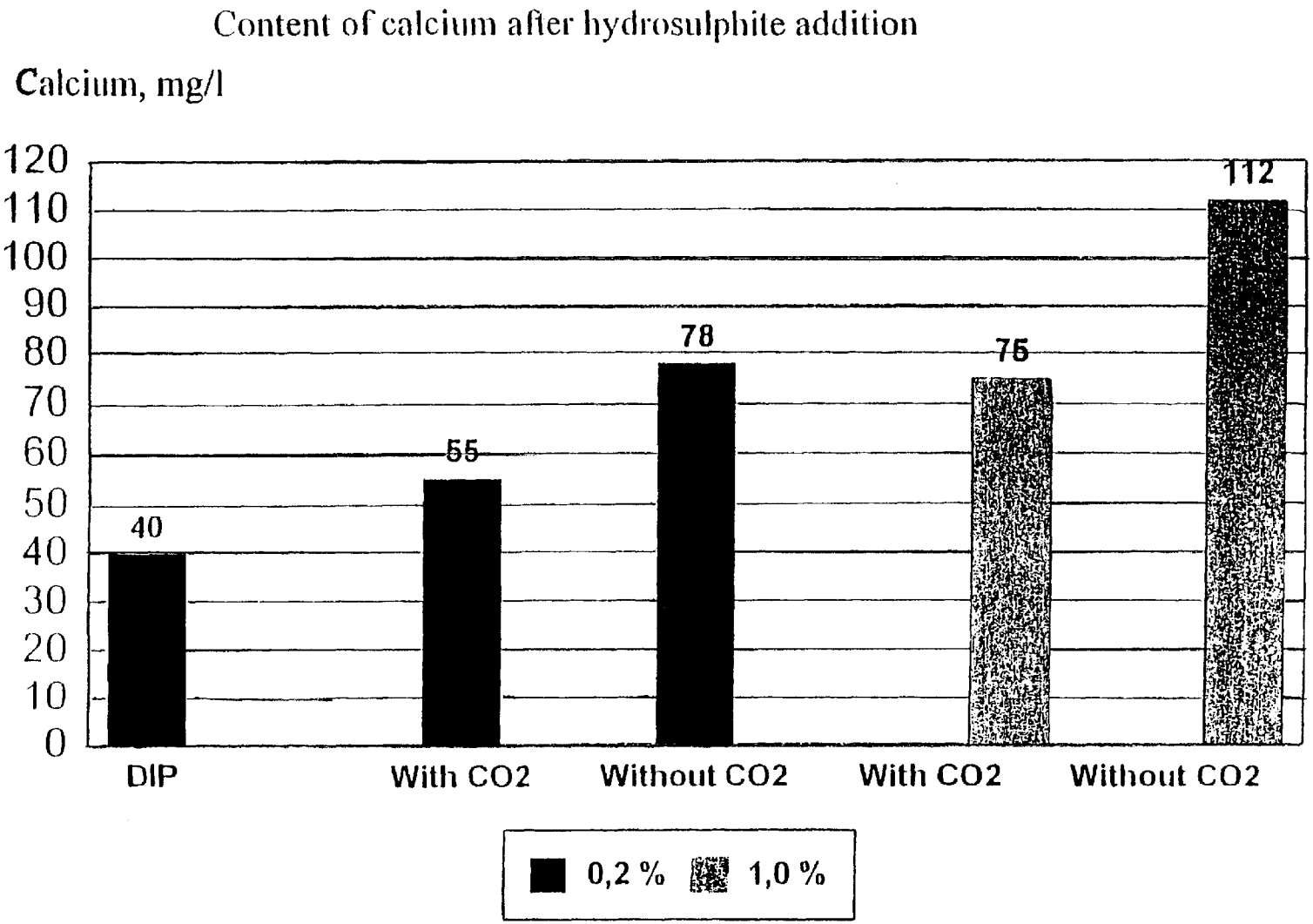

In test No. 3. the pH of a DIP suspension was adjusted a) without CO2 (with $H_2SO_4$) and b) with $CO_2$, and the effect of a hydrosulphite addition of 0.2% and 1.0%, respectively, on the dissolution of calcium carbonate was analyzed. The results are indicated in FIG. 3 (Content of calcium after hydrosulphite addition).

The results of tests No. 1 to 3 clearly show that the dissolution of calcium carbonate is significantly lower when carbon dioxide has been introduced into the pulp.

In test No. 4 the pH of a TMP suspension was adjusted with a) $H_2SO_4$ and b) $CO_2$. The effect of calcium carbonate and carbon dioxide on colloidal size extractives was measured. It was found that the original $H_2SO_4$ adjusted TMP had 27 mg/l colloidal size extractives in the filtrate; the same TMP to which $CaCO_3$ had been added, had 21 mg/l colloidal size extractives; while the $CO_2$ treated $CaCO_3$ containing TMP had as much as 35 mg/l colloidal size extractives in the filtrate. This indicates that the extractives are more agglomerated with calcium in case the pH adjustment is made with $H_2SO_4$ than with $CO_2$.

EXAMPLE 2

Processing of Recycled Fibers a) Reference Example; Use of Sulfuric Acid

A waste paper material containing varying amounts and forms of calcium carbonate is disintegrated in a pulper of a de-inking process and de-inked at highly alkaline conditions (pH 10–13). In the following stages of the process the pH of the pulp suspension is gradually reduced with 17–18 kg/ton of sulfuric acid (93%) to a final pH level of 7 to ensure the efficient functioning of the chemicals used.

As the pH level reaches 8 or below it the calcium carbonate in solid form begins to dissolve and dissociates into free calcium ions and carbonate ions and carbon dioxide may be formed. The amount of calcium ions free to react with other inorganic or organic substances increases in the pulp suspension and in the recirculating process waters.

In a subsequent paper production at pH 7 or lower the well known problems with calcium precipitations and foaming are observed.

b) Working Example: Use of Carbon Dioxide

The above example is repeated with the exception that carbon dioxide is used to lower the pH to the critical pH of 8 and below. The carbon dioxide is introduced into the pulp right after the pH reaches the critical level for calcium carbonate dissolution. The carbon dioxide dissolves in the pulp suspension and it also enters the process waters recirculating in the de-inking plant. The dissolution of solid calcium carbonate at pH below 8 is significantly slowed down and reduced. The amount of carbon dioxide is metered according to the desired pH.

The de-inked pulp is used in a paper making process operating at a pH level of about 7 or lower. Additional carbon dioxide is added into the pulp at the delivery side of an MC-pump pumping the de-inked pulp into a storage tank just before the pulp at higher pH meets the process waters of the paper machine that are at a lower pH. The sufficient amount of carbon dioxide is determined by monitoring the pH to a level of about 7. There is only insignificant dissolution of calcium carbonate in the storage tank. The calcium carbonate entering the paper making process remains substantially in solid form and leaves the process in solid form within the paper web thus avoiding the problems caused by the dissociation of calcium carbonate. The use of carbon dioxide also enables a higher rate of utilization of de-inked pulp as a whole.

EXAMPLE 3

Dosing of Acidic Process Chemicals into $CaCO_3$ Containing Stock

A pulp suspension consisting of a blend of de-inked pulp (DIP) and thermomechanical pulp (TMP) and including a significant amount of calcium carbonate deriving from recycled fibers is used for the production of fully dyed paper. The pH of the stock is adjusted to pH 6, A) according to the prior art with sulfuric acid, and B) according to the present invention with carbon dioxide. In the stock preparation an addition of about 5 kg/ton of an acidic process chemical is made to the stock.

The acid addition causes a sudden local reduction of the pH of the stock which accelerates the dissolution of calcium carbonate. The amount of dissolved calcium is measured in the laboratory and is found to be in case A) above 100 mg/l, and in case B) below 90 mg/l.

This indicates that by adding carbon dioxide into the stock in connection with the addition of acidic process chemicals, the effect of sudden pH reduction on the dissolution of calcium carbonate can be alleviated.

EXAMPLE 4

Dosing of Bleaching Agents into $CaCO_3$ Containing Stock

A pulp suspension consisting of a blend of de-inked pulp (DIP) and thermomechanical pulp (TMP) and including a significant amount of calcium carbonate deriving from recycled fibers is bleached using dithionite (hydrosulphite) as bleaching agent. The pH is adjusted to about 6 before the bleaching A) with sulfuric acid and B) with carbon dioxide.

The bleaching typically causes a reduction of pH which accelerates the dissolution of calcium carbonate which is present in solid form in the process. The introduction of carbon dioxide into the pulp significantly reduces the effect of the bleaching agent. With an addition of about 2 kg/ton of hydrosulphite the content of dissolved calcium in the pulp is found to be about 80 mg/l in case A) and about 55 mg/l in case B).

This indicates that the use of carbon dioxide can alleviate the problem of calcium carbonate dissolution in a pulp suspension.

EXAMPLE 5

$CaCO_3$ as a Filler or Coating Pigment in Paper Making at a Pseudoneutral pH Calcium carbonate is a used as a filler or coating pigment in the production of paper from a pulp containing a significant amount of mechanical pulp. Because of the mechanical pulp the paper making process is run in the acidic or pseudoneutral area (a pH at which calcium carbonate is normally solubilized).

Carbon dioxide is introduced into the papermaking process to provide a final pH of 6.5 in the stock preparation. Because of the carbon dioxide addition the dissolution of the calcium carbonate is retarded. A substantial amount of the calcium carbonate in the stock is retained in solid form and is removed with the paper web. The amount of free calcium ions found in the recirculating process waters remains at an acceptable level causing no significant problems.

EXAMPLE 6

$CaCO_3$ as Filler in Acidic Paper Making a) Reference Example: Use of Sulfuric Acid In a partly integrated paper mill bales of fully bleached kraft market pulp are introduced into a pulp slusher. The pH in the slusher is adjusted with aqueous NaOH to a pH of approximately 11.

After slushing, paper making chemicals and sulfuric acid are added to the slushed pulp suspension. As a consequence of this, the pH of the pulp suspension decreases from pH 11 to about pH 6.5–6.8, which pH is maintained in the short circulation of the subsequent papermachine.

Calcium carbonate is used as filler and therefore the acidic white water contains dissolved calcium carbonate and a large amount of calcium ions. Precipitations of calcium salts occur in the process.

Calcium carbonate filler is added to the diluted stock at an excess since the acid environment quickly dissolves substantial portions thereof, causing foaming as carbon dioxide gas is released.

b) Working Example: Use of Carbon Dioxide

The process described above is changed in order to improve the situation.

The pH adjustment in the process is performed by the use of carbon dioxide only and the dilution water contains no sulfuric acid. The alkaline pulp suspension is acidified to a pH of about 6.5 with carbon dioxide just prior to the stock preparation tank.

The acidic white water consequently contains significantly less dissolved calcium carbonate. A larger proportion of the added calcium carbonate is retained in solid form and is removed as filler in the web formed in the paper making process.

EXAMPLE 7

In a paper mill bales of recycled waste paper are introduced into a deinking plant. The pH in the repulping process is adjusted with aqueous NaOH to a pH of approximately 11. The repulped suspension goes through the steps of screenings, flotations, dilutions and thickenings. Chemicals and recirculating waters are added to the pulp stream at various point of processing. As a consequence of this, the pH of the pulp suspension decreases from pH 11 to about pH 7.2 at the final stage prior to feeding the same to a stock preparation tank.

The paper making process is run at an acidic pH of about 5.5. For the paper making the pH of the pulp entering the stock preparation tank is acidified to a pH of about 5.5 by adding to the pipe leading into said tank A) sulfuric acid according to the prior art, and B) carbon dioxide gas according to the present invention.

The acidified pulp is diluted with white water from the paper making process. In case A) the acidic white water contains large amounts of dissolved calcium carbonate filler. Precipitations of calcium salts occur and cause disturbance in the process. When the stock is brought into an open vessel a strong foaming reaction is noted. Acetic acid fed into the stock causes additional foaming.

In case B) the acidic white water dissolves significantly less calcium carbonate. No disturbing precipitations of calcium salts are noted. The filler is mainly retained in a solid state and a larger portion thereof is removed from the system as paper is formed from the stock. The stock does not have problems with foaming in open vessels. Addition of acetic acid progresses smoothly without problems with foaming.

A laboratory analysis of the pulps A and B fed into the stock preparation tank gives the following results:

| | A ($H_2SO_4$) | B ($CO_2$) |
|---|---|---|
| Pulp | | |
| dry substance (DS), % | 6.2 | 25.2 |
| Ca as carbonate, %/DS | 1.6 | 2.7 |
| Aqueous filtrate[1] | | |
| pH 6.4 | 7.2 | |
| solid substance (0.45 $\mu$m), mg/l | 80 | 15 |
| Ca content, mg/l | 1340 | 312 |

[1]The pulp suspension is filtered under vacuum, whereby all free carbon dioxide escapes raising the pH.

The example shows that the acidulation with carbon dioxide provides a well functioning improvement over the prior art acidulation process and that it also provides a significant improvement in the calcium carbonate balance of the system.

It is evident to those skilled in the art that the invention may be varied in a great number of ways which are obvious to those skilled in the art without deviating from the scope of the claims.

What is claimed is:

1. A process for preventing or substantially retarding the dissolution of calcium carbonate in a papermaking system comprising providing an aqueous pulp suspension containing solid calcium carbonate in said papermaking system, retarding dissolution of said solid calcium carbonate and reducing precipitation of calcium salts by introducing carbon dioxide alone to said solid calcium carbonate containing pulp suspension prior to or in connection with subjecting said solid calcium carbonate in said papermaking system to pH conditions of 8 or lower, said carbon dioxide being introduced to said pulp suspension in an amount sufficient to significantly retard dissolution of said solid calcium carbonate in said pulp suspension and reduce the amount of free calcium ions in said papermaking system.

2. The process according to claim 1, wherein said calcium carbonate is present in said pulp suspension as a filler and/or a pigment.

3. The process according to claim 2, wherein said carbon dioxide is introduced at a location physically close to the point of addition of calcium carbonate.

4. The process according to claim 1, wherein said calcium carbonate in said pulp suspension derives from recycled fibers or broke containing calcium carbonate as filler or pigment.

5. The process according to claim 1, wherein said carbon dioxide is introduced into a stream of pulp suspension.

6. The process according to claim 1, wherein said carbon dioxide is introduced into a stream of water which is then added to said pulp suspension.

7. The process according to claim 1, wherein said carbon dioxide or additional carbon dioxide is introduced into said calcium carbonate containing pulp suspension just prior to or in connection with an acidic process chemical being added to said pulp suspension.

8. The process according to claim 1, wherein said pH conditions comprise a pH of 7.5 to 7.

9. The process according to claim 1, wherein said carbon dioxide is used in an amount which causes a significant lowering of the pH of said pulp suspension.

10. The process according to claim 9, wherein said carbon dioxide is introduced in an amount sufficient for lowering the pH of said pulp suspension to a pH level of about 7.6 or lower.

11. The process according to claim 9, wherein the pH of said pulp suspension is adjusted with carbon dioxide to a pH of 5.5 to 7.6.

12. The process of claim 11, wherein said pH is adjusted to 6.5–7.5.

13. The process according to claim 1, wherein said pulp suspension is recycled pulp, chemical pulp or mechanical pulp.

14. The process according to claim 13, wherein said pulp suspension is recycled pulp containing a significant amount of calcium carbonate.

15. The process according to claim 14, wherein said carbon dioxide is introduced into a deinking plant for processing recycled fibers at an alkaline pH.

16. The process according to claim 14, wherein said carbon dioxide is introduced prior to and/or in connection with said calcium carbonate containing pulp suspension being diluted with water having a pH of 8 or lower.

17. The process according to claim 13, wherein said carbon dioxide is introduced prior to a dithionite bleaching of said calcium carbonate containing pulp suspension.

18. The process according claim 13, wherein said carbon dioxide is introduced just before said calcium carbonate containing recycled pulp enters a paper making process operating at a neutral or acidic pH.

19. The process according to claim 18, wherein said carbon dioxide is introduced in connection with pumping said calcium carbonate containing recycled pulp to a storage tank of a paper machine.

20. The process according claim 1, wherein said aqueous pulp suspension is a chemical or mechanical pulp or stock substantially devoid of calcium carbonate and said calcium carbonate comprises solid filler which is added into said pulp suspension in a paper making process.

21. The process according to claim 20, wherein said calcium carbonate is added in a stock preparation step, optionally prior to and/or in a stock preparation tank.

22. The process according to claim 20, wherein calcium carbonate is added to said pulp suspension with process water recirculated from said papermaking process.

23. The process according to claim 22, wherein said carbon dioxide is introduced into said process water.

24. The process of claim 1 wherein said aqueous pulp suspension containing solid calcium carbonate is initially selected from at least one of the group consisting of a pulp suspension of pH greater than 8 in which calcium carbonate has been added as a filler, a re-circulated broke at a pH greater than 8 containing solid calcium carbonate as a coating pigment, and a pulp suspension at pH greater than 8 derived from recycled fibers containing solid calcium carbonate.

25. A process for producing paper or board in a papermaking system wherein solid calcium carbonate is present, comprising providing an aqueous pulp suspension containing solid calcium carbonate in said papermaking system, retarding dissolution of said solid calcium carbonate and reducing precipitation of calcium salts by introducing carbon dioxide to said pulp suspension in connection with subjecting said solid calcium carbonate in said system to pH conditions of 8 or lower, said carbon dioxide being added into said pulp suspension in an amount which substantially retains said solid calcium carbonate in an undissolved state for a time sufficient for said stock to be processed into a web, feeding said solid calcium carbonate containing pulp suspension via stock preparation steps to a web forming device, and processing said web into paper having solid calcium carbonate filler.

26. The process according to claim 25, wherein additional carbon dioxide is introduced to said stock at a subsequent process step prior to web forming.

27. The process according to claim 25, wherein carbon dioxide is introduced into said suspension in an amount sufficient to significantly increase the amount of undissolved calcium carbonate in the stock entering said web forming device compared to a corresponding stock which has not been treated with carbon dioxide.

28. The process according to claim 25, wherein said paper is produced at a substantially neutral pH.

29. A process for producing paper or board from recycled fibers, which process comprises processing recycled fibers including calcium carbonate at an alkaline pH to provide a solid calcium carbonate containing alkaline recycled pulp suspension;

retarding dissolution of said solid calcium carbonate and reducing precipitation of calcium salts by introducing carbon dioxide to said solid calcium carbonate containing pulp suspension prior to or in connection with said solid calcium carbonate containing pulp suspension being subjected to pH conditions of 8 or lower, feeding said pulp suspension to stock preparation in a paper making machine; and producing paper including solid calcium carbonate filler from said stock.

30. The process according to claim 29, wherein said processing includes deinking said pulp suspension in one or more stages.

31. The process according to claim 29, wherein said paper is produced at a neutral or acidic pH.

32. A process for preventing or substantially retarding the dissolution of calcium carbonate in a papermaking system comprising providing an aqueous pulp suspension containing solid calcium carbonate in said papermaking system, retarding dissolution of said solid calcium carbonate and reducing precipitation of calcium salts by introducing carbon dioxide to said solid calcium carbonate containing pulp suspension prior to or in connection with subjecting said solid calcium carbonate in said papermaking system to pH conditions of 8 or lower, said carbon dioxide being introduced without introduction of calcium oxide or calcium hydroxide with said introduction of said carbon dioxide, and wherein said carbon dioxide is introduced to said pulp suspension in an amount sufficient to significantly retard dissolution of said solid calcium carbonate in said pulp suspension and reduce the amount of free calcium ions in said papermaking system.

* * * * *